US005081850A

United States Patent [19]

Wakatsuki et al.

[11] Patent Number: 5,081,850

[45] Date of Patent: Jan. 21, 1992

[54] REFRIGERATOR

[75] Inventors: Yuji Wakatsuki; Shigekazu Kondo; Mitsuyuki Takaoka; Masaru Hirosawa; Nobuya Suzuki, all of Toyoake, Japan

[73] Assignee: Hoshizaki Denki Kabushiki Kaisha, Aichi, Japan

[21] Appl. No.: 527,127

[22] Filed: May 22, 1990

[30] Foreign Application Priority Data

May 25, 1989 [JP] Japan ..... 1-133764
Jun. 7, 1989 [JP] Japan ..... 1-66366[U]

[51] Int. Cl.[5] ..... F25D 17/08
[52] U.S. Cl. ..... 62/405; 62/441
[58] Field of Search ..... 62/253, 255, 256, 405, 62/441, 404

[56] References Cited

U.S. PATENT DOCUMENTS 2,775,873 1/1957 Jones ..... 62/405
3,864,936 2/1975 Frank et al. ..... 62/405

*Primary Examiner*—Albert J. Makay
*Assistant Examiner*—J. Sollecito
*Attorney, Agent, or Firm*—Koda and Androlia

[57] ABSTRACT

The refrigerator of this invention includes a thermal insulating box, an upper storing box and a lower storing box within the thermal insulating box, and a cooling unit arranged above the upper storing box. An interior space within the thermal insulating box is divided into a first passage communicating with a cold air blowing side of the cooling unit to cool the storing box while lowering the cold air and a second passage communicating with a cold air sucking side of the cooling unit to cool the storing box while raising the cold air descended down to the bottom part of the thermal insulating box and to return the cold air to the cooling unit. A space having the cooling unit stored therein is divided by a partition wall into a first chamber having the cooling unit arranged therein and a second chamber having an air blowing fan arranged therein. The partition wall is provided with through-holes at locations corresponding to the cold air passage within the first chamber.

4 Claims, 9 Drawing Sheets

REFRIGERATOR

FIELD OF THE INVENTION

This invention relates to a refrigerator in which storing boxes are arranged within a thermal insulating box through a predetermined space, and more particularly, a refrigerator capable of providing a uniform cooling within the storing boxes.

BACKGROUND OF THE INVENTION

When fresh foods such as vegetables, fruits or other meats and fishes (hereinafter called as "meal products") are frozen and stored for a long period of time in a refrigerator or the frozen meal products are gradually frozen. In general it is necessary to restrict a variation of temperature within the refrigerator, restrict an evaporation of moisture from the meal products and monitor the evaporation.

In order to accommodate this requirement, it is well known in the art to provide a refrigerator in which brine (antifreeze) is used as a cooling medium. This type of refrigerator is operated such that the brine stored in a brine tank is cooled by an evaporator connected to a freezing system and the cooled brine is circulated within a cooling pipe arranged outside of the storing boxes used to store meal products, so as to provide cooling within the refrigerator.

However, the refrigerator using the above-mentioned brine arrangement had some disadvantages in that the mechanism for cooling the above-mentioned brine or the pipings are complicated and its manufacturing cost is increased. In addition, in order to perform a defrosting operation in the refrigerator, it is necessary to heat the brine up to a predetermined temperature and to circulate it in the cooling pipes. In this case, not only a high heating calorie is required for heating the brine, but also a temperature within the refrigerator is increased more than a required temperature due to the circulation of the brine, resulting in the degree of freshness of the stored meal products being deteriorated.

In view of the foregoing, there is provided a utility model entitled "Raw and Fresh Food Products Storing Device" of Jap.U.M.Laid-Open No. Sho 63-147678, for example. This device is provided with meal products storing boxes which are arranged within the storing chamber having a thermal insulating structure through a predetermined space. In addition, the space is divided into an air passage on a casing side for flowing cold air without being contacted with the storing boxes and an air passage on the storing boxes side for flowing cold air while being contacted with the storing boxes by a horizontal partition plate and a vertical partition plate. The cold air cooled by the evaporator arranged within the air passage at the casing flows down at first within the air passage at the casing side and drops onto the bottom part of the storing chamber, thereafter the air is heat exchanged with the storing boxes while ascending in the air passage at the storing boxes, thereby the storing boxes are cooled.

In case of the above-mentioned raw and fresh food products storing device, the cooled cold air flows down to a bottom part of the storing chamber, thereafter the storing boxes are cooled while the cold air ascends. However, if the cold air flows down once to the bottom part of the storing chamber, this cold air is accumulated without being lifted up, only the lower portion of each of the storing boxes is cooled and so uniform cooling of entire storing boxes is quite difficult. Due to this fact, in the prior art, it required much time for an interior of the refrigerator to be cooled until it reaches a predetermined temperature (i.e. food products storing temperature), resulting in the disadvantage in that the consumption of power is increased. In addition, this prior art has a problem that a difference in temperature within the refrigerator housing is generated and certain food products may show a rapid reduction in freshness due to a partial cooling within the storing boxes.

In case of a system in which a plurality of storing boxes are arranged within the storing chamber in an upper and a lower positional relationship, a housing temperature becomes non-uniform between the upper and lower storing boxes and a problem that a degree of freshness of the food products stored in the upper storing box is decreased due to a lack of cooling action within the upper storing box is created.

OBJECTS OF THE INVENTION

This invention has been proposed to solve the above-mentioned disadvantages which are present in the refrigerator constructed in a double structure having the storing boxes within the above-mentioned thermal insulating box and it is an object of this invention to provide a refrigerator capable of performing a rapid cooling of an interior of the refrigerator down to a predetermined temperature and further uniform housing temperature under a simple configuration.

SUMMARY OF THE INVENTION

In order to overcome the above-mentioned problems and accomplish the desired objects, this invention is a refrigerator comprising a thermal insulating box having an opening and thermal insulation doors arranged in the opening, storing boxes arranged in the thermal insulating box through a desired space and a cooling unit arranged above the storing box in the thermal insulating box. The interior space of the thermal insulation box is divided into a first passage for communicating with a cold air blowing side of the cooling unit so as to cool the storing boxes while descending the cold air blown from the cooling unit and a second passage communicating with a cold air suction side of the cooling unit and lifting the cold air descended down to a bottom part of the thermal insulating box so as to cool the cooling unit again and to guide it to return to the cooling unit.

The refrigerator of this invention is, in another aspect, comprised of a thermal insulating box having an opening and thermal insulating doors arranged at the opening, storing boxes arranged at the opening of the thermal insulating box through a desired space and having openings in correspondence with the former opening, a cooling unit arranged above the storing box in the thermal insulating box and an air blowing fan arranged adjacent to the cooling unit. The refrigerator is further composed of a partition wall for dividing a space formed above the storing box into a first chamber having the cooling unit arranged therein and a second chamber having the air blowing fan arranged therein and having ports communicating both chambers, a cold air passage formed between the bottom surface of the cooling unit arranged in the first chamber and a ceiling surface of the storing box, and through-pass holes made at the locations in the partition wall corresponding to the cold air passage in the first chamber and in which a part of the cold air cooled by the cooling unit is circulated in the cold air passage in the first chamber to cool the ceiling surface of the storing box and at the same time a part of the cold air circulating in the cold air passage is fed into the second chamber through the through-holes in the partition wall.

As described above, according to this invention, since the storing boxes are cooled when the cold air cooled within and above the thermal insulating box descends in a passage defined between the thermal insulating box and the storing boxes and when the cold air ascends, it is possible to reduce the time required for cooling the storing boxes to their predetermined temperatures and further to reduce the running cost. In addition, the cold air does not cool only the bottom part of each of the storing boxes, resulting in the entire storing boxes being uniformly cooled and so that it has an advantage that deterioration of the degree of freshness of the food products stored within the storing boxes can be effectively prevented.

In addition, the second chamber having the air blowing fan stored and arranged therein is communicated with a cold air passage defined above a ceiling surface of the storing box via through-holes formed on the partition wall. As a result a part of the cold air just after blowing-off from the cooling unit may easily be blown into the cold air passage and then a short-cycle flow is positively carried out. That is, in this invention the ceiling surface of each of the storing boxes can be efficiently cooled and the entire storing boxes can be uniformly cooled within a short period of time.

DETAILED DESCRIPTION OF THE INVENTION

Figure 1:
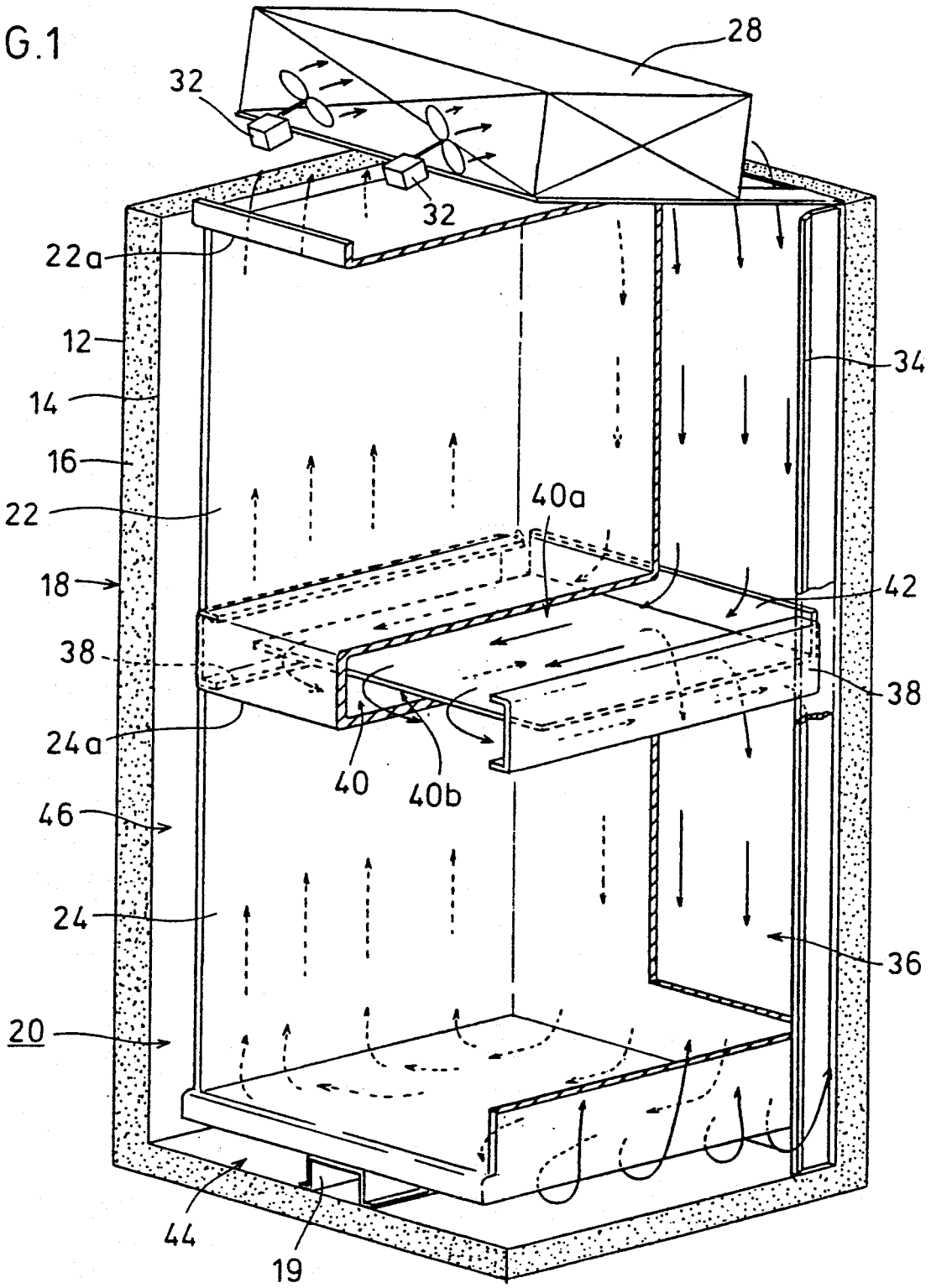
FIG. 1 is a perspective view for showing partly in a longitudinal section a vertical refrigerator constructed in accordance with one preferred embodiment of this invention.

Referring now to the drawings, some preferred embodiments of the refrigerator of this invention will be described. In the preferred embodiments, a refrigerator having two storing boxes arranged at an upward and downward relation within a thermal insulating box will be described. However, this invention is not restricted to this arrangement, but one or more storing boxes may be applied.

FIG. 1 is a perspective view in a longitudinal section for showing a vertical refrigerator constructed in accordance with one preferred embodiment of this invention, in which, a refrigerator 10 has a themal insulating box 18 that is comprised of an outer box 12 having rectangular openings 12*a* and 12*a* spaced apart by a predetermined distance in a vertical direction, an inner box 14 assembled in this outer box 12 spaced apart from the outer box 12 by a predetermined space, and a thermal insulation material 16 such as urethane foam and the like filled between the boxes 12 and 14. Within the inner box 14 in the thermal insulating box 18 are arranged an upper storing box 22 and a lower storing box 24 piled up through shielding plates 38 and 38, described later, while a predetermined space 20 being held against its inner surface. The storing boxes 22 and 24 are formed of a good thermal conducting metallic plate such as a stainless steel plate and the like.

Figure 3:
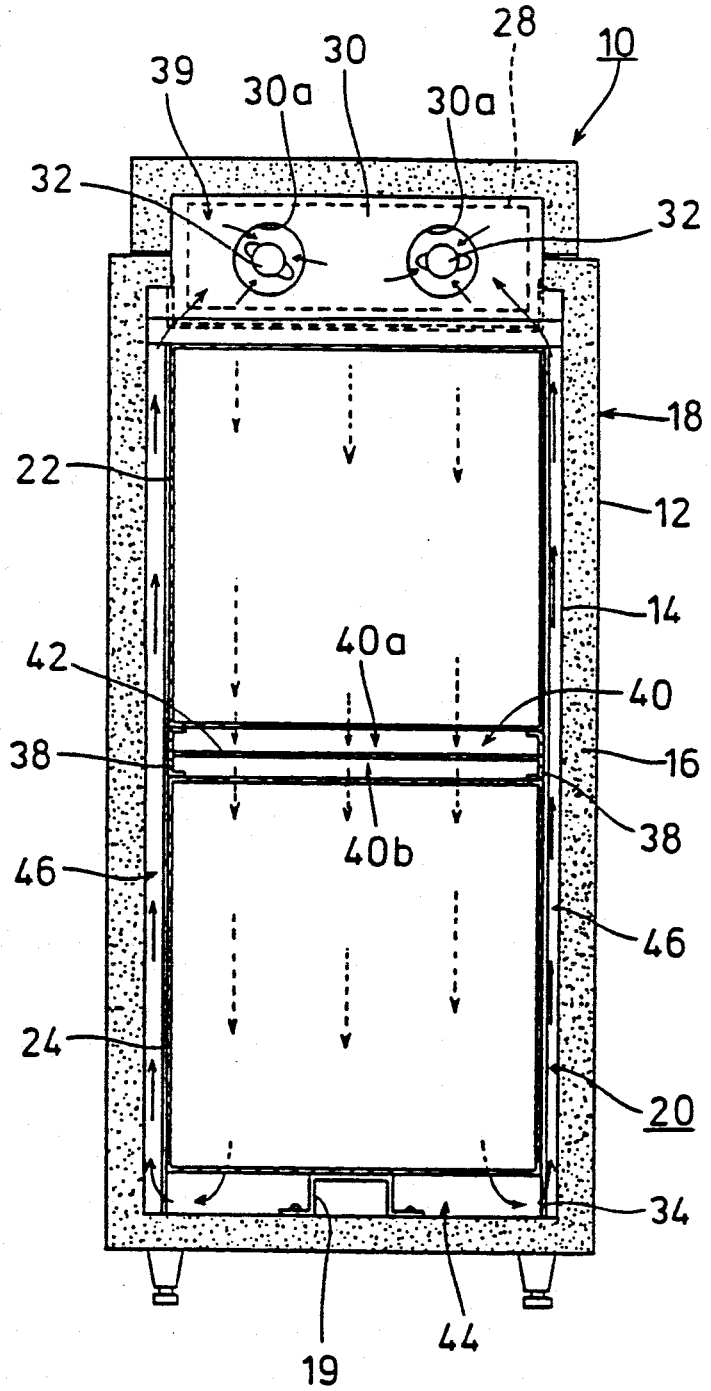
FIG. 3 is a longitudinal front elevational view in section for showing a refrigerator shown in FIG. 1.
Figure 4:
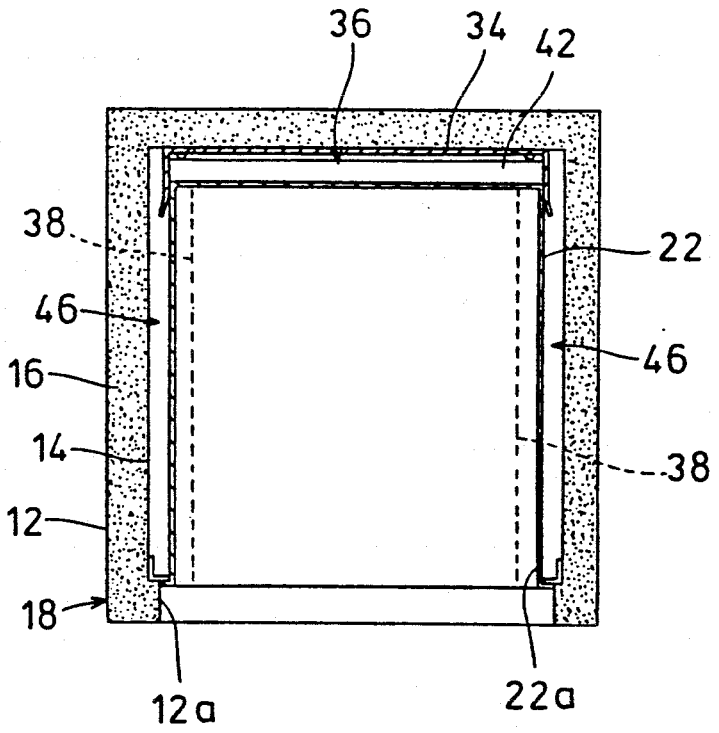
FIG. 4 is a cross sectional view for showing a refrigerator shown in FIG. 1.

As shown in FIG. 3, at an inner bottom surface of the inner box 14 is arranged a supporting member 19 projecting from a bottom surface by a predetermined height at a central part of its width direction. The lower storing box 24 is mounted on the supporting member 19 and then a bottom space 44 is defined between the lower storing box 24 and the bottom surface of the inner box 14. As shown in FIG. 4, at an inner rear surface of the inner box 14 is extended vertically a storing box guide 34 formed in a ⊓-shape opened in a forward direction as viewed in its top plan view. Rear surfaces of both storing boxes 22 and 24 are fitted to the opening of this guide 34.

As described later, between the rear surfaces of the storing boxes 22 and 24 and an inner surface of the storing box guide 34 is defined a rear surface passage 36 acting as a first passage for guiding the cold air so as to cool the storing boxes 22 and 24 with the falling the cold air. In addition, width sizes of the storing boxes 22 and 24 is set smaller than an inner size of the inner box 14, thereby as shown in FIG. 4, at both side surfaces of the storing boxes 22 and 24 are defined side passages 46 and 46 acting as a second passage for guiding the cold air to cool the storing boxes 22 and 24 with the raising the cold air. That is, the space 20 defined between the inner wall of the inner box 14 and the outer walls of the storing boxes 22 and 24 is constituted by a rear surface passage 36, a bottom space 44 and side surface passages 46 and 46.

Figure 2:
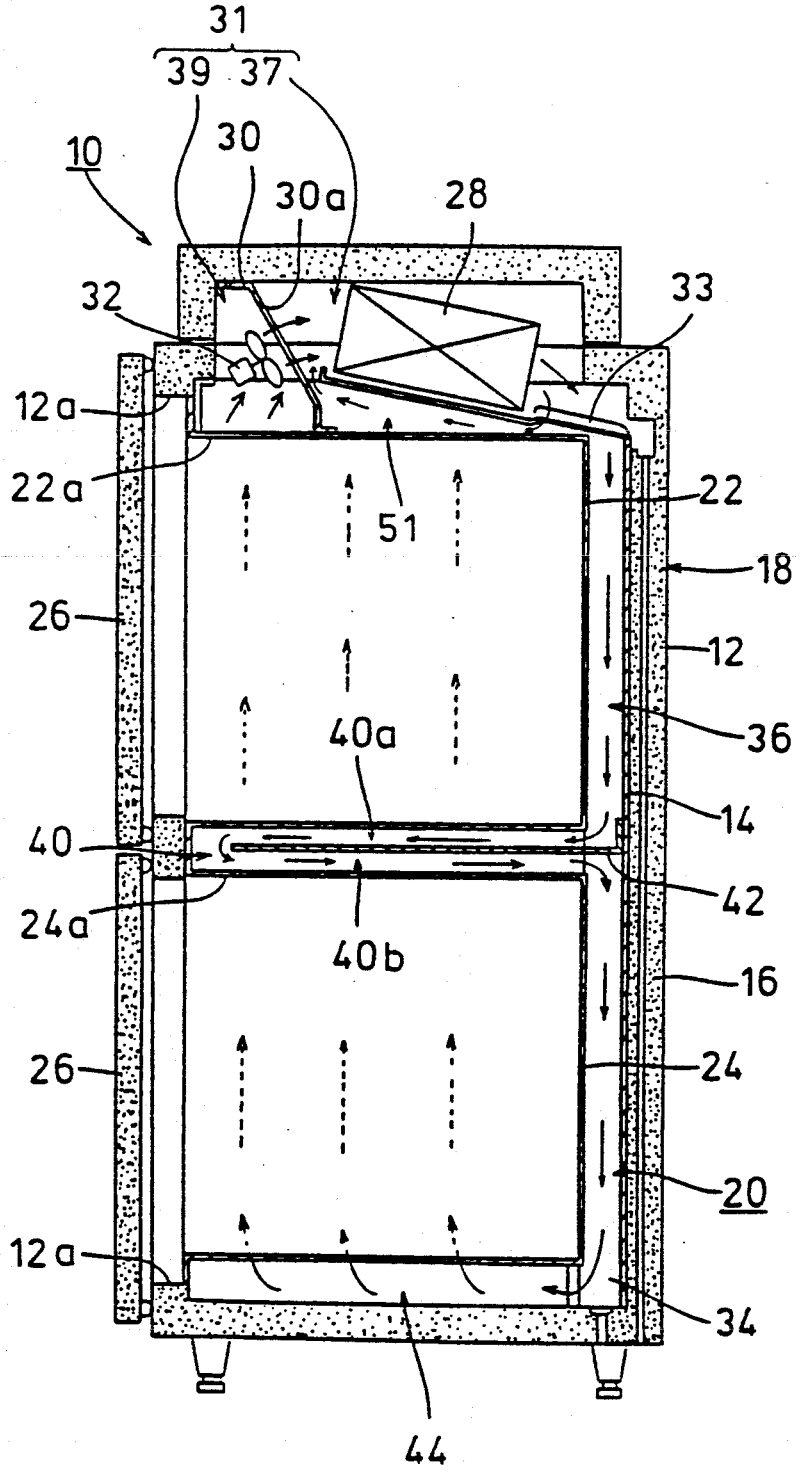
FIG. 2 is a longitudinal side sectional view in elevation for showing a refrigerator shown in FIG. 1.

The storing boxes 22 and 24 have rectangular openings 22*a* and 24*a* in correspondence with the rectangular openings 12*a* and 12*a* formed in the thermal insulating box 18. As shown in FIG. 2, at the front surface of the themal insulating box 18 are provided thermal insulating doors 26 for closing the openings 12*a* in such a way that the openings 12*a* may be opened or closed in correspondence with each of the openings 12*a* formed in the thermal insulating box 18.

A space 31 defined between an inner ceiling surface of the inner box 14 and a ceiling surface of the upper storing box 22 is divided into two chambers 37 and 39 through a partition wall 30 as shown in FIG. 2. A first chamber 37 communicating with the rear surface passage 36 is provided with a cooling unit 28 communicating with a freezing device not shown so as to circulate the refrigerant from the freezing device to an evaporator stored in it. The second chamber 39, communicates with the side passages 46 and 46. The second chamber 39 communicates with aforesaid side passages 46, 46 and is provided with an air blowing fan 32 in correspondence with a plurality of openings 30*a* (two in the preferred embodiment) formed in the partition wall 30. Since this air blowing fan 32 is arranged so as to feed air in a direction toward the first chamber 37, the air within the refrigerator is sucked through the side passages 46 and 46 by the operation of the air blowing fan 32 is contacted with the cooling unit 28 through the openings 30*a*, thereafter the air is blown to the rear passage 36.

Reference numeral 33 denotes a water draining pan arranged below the cooling unit 28, and water which drops from the cooling unit 28 are transmitted along the water draining pan 33 and discharged out of the refrigerator. As shown in FIG. 2, a cold air passage 51 having a predetermined size is defined between the bottom surface of the water draining pan 33 and the ceiling surface of the upper storing box 22. In addition, between the cooling unit 28 and the partition wall 30 is defined a clearance of predetermined size communicating with the cold air passage 51. That is, a part of the cold air cooled by the cooling unit 28 and just after being blown to the rear passage 36 may perform a so-called short cycle operation where the air is circulated in the cold air passage 51 within the first chamber 37 so as to perform an efficient cooling of the ceiling surface of the upper storing box 22.

As shown in FIG. 3, the upper storing box 22 and the lower storing box 24 are piled up through ⊓-shaped shielding plates 38 and 38 oppositely provided on both right and left side edges. The shielding plates 38 and 38 act to define a horizontal passage 40 of predetermined size between the storing boxes 22 and 24. As described later, the shielding plates 38 are extended over an entire length of the storing box 22 in its depth direction and provides a function to prevent cold air fed from the rear passage 36 into the horizontal passage 40 from escaping to the side passages 46 and 46. A front side of the horizontal passage 40 is also closed and the passage 40 is communicated only with the rear passage 36 at its rear side.

As shown in FIG. 2, at a location opposite to the horizontal passage 40 of the storing box guide 34 is projected a partition plate 42 dividing the horizontal passage 40 into the upper and lower segments. A size of this partition plate 42 is set in such a way that both sides of the partition plate are abutted against the shielding plates 38 and 38 and a clearance having a predetermined size communicating with the upper passage 40*a* and the lower passage 40*b* is provided at the projecting extreme end of the partition plate. Accordingly, the cold air blown from the cooling unit 28 into the rear passage 36 may strike against the partition plate 42 and fed into the upper passage 40*a* of the horizontal passage 40, passed through the lower passage 40*b* from the extreme end of the partition plate 42, thereafter the air is flown again into the rear passage 36. In this way, the cold air flowing in the rear passage 36 is flown in the horizontal passage 40 to cause the cold air to contact with the bottom surface of the upper storing box 22 and the ceiling surface of the lower storing box 24, resulting in that the cooling action of the storing boxes 22 and 24 can be promoted.

The cold air passed through the lower passage 40*b* and flown again into the rear passage 36 flows down the rear passage 36, thereafter as shown in FIG. 3, is blown to the bottom space 44 defined at the bottom surface of the lower storing box 24, and then the air ascends in the side passages 46 and 46 and returns to the cooling unit 28.

Figure 5:
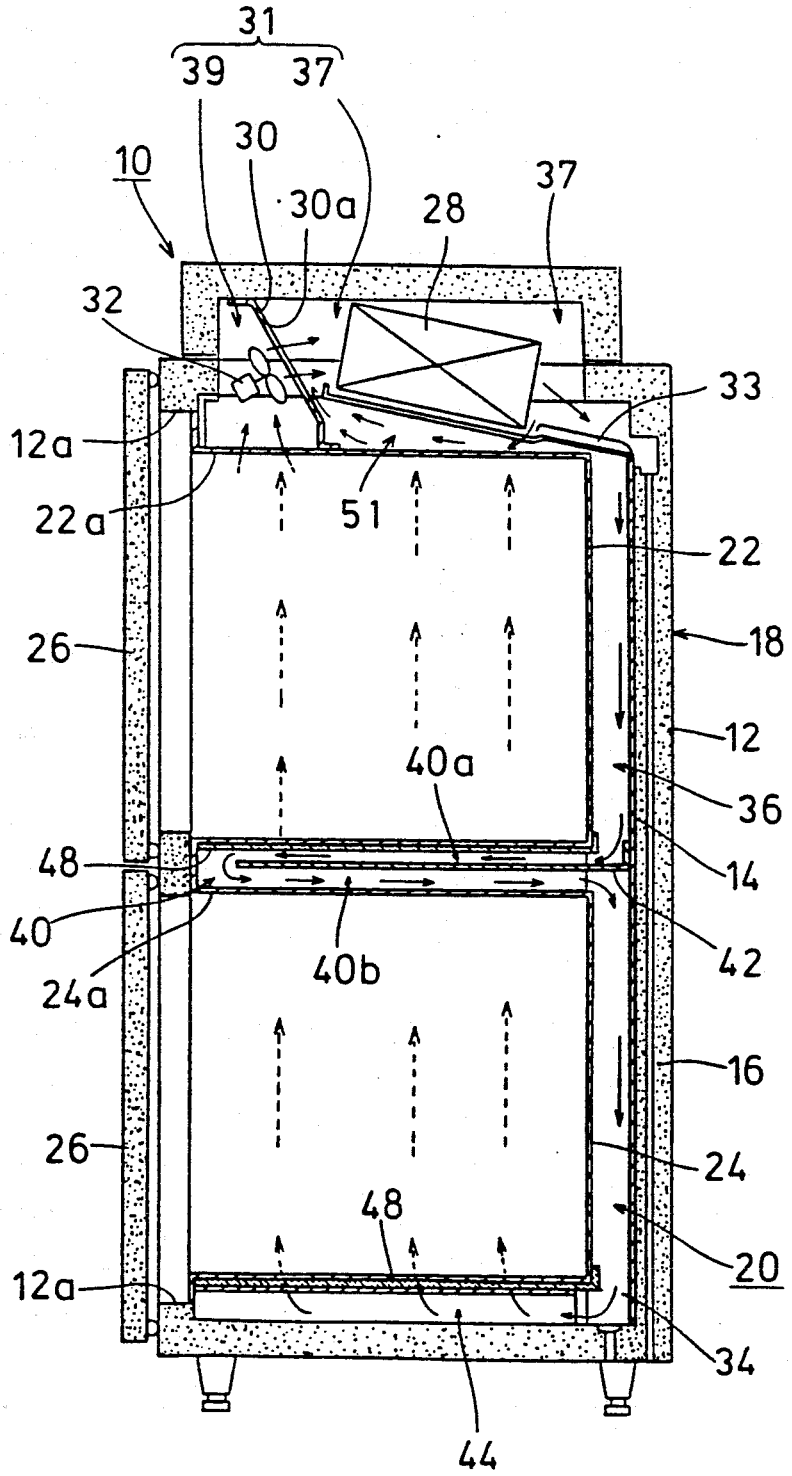
FIG. 5 is a longitudinal side sectional view in elevation for showing a refrigerator constructed in accordance with a modified example of the preferred embodiment shown in FIG. 1.

Then, FIG. 5 illustrates a modification of the preferred embodiment of this invention, in which at the bottom surfaces of the storing boxes 22 and 24 is provided thermal insulating members 48 over their entire surfaces. In this case, the cold air flown from the rear passage 36 into the upper passage 40*a* of the horizontal passage 40 does not contacted directly with the bottom surface of the storing box 22, so that the storing box 22 can not be cooled with the cold air. Similarly, the storing box 24 may not be cooled with the cold air flowed from the rear passage 36 into the bottom space. Accordingly, the storing boxes 22 and 24 are cooled only at their ceiling surfaces, rear surfaces and side surfaces.

That is, since the cold air has a characteristic to flow from an upper part to a lower part, if the storing box 22 (24) is cooled at its ceiling surface, rear surface and side surfaces, the air within the refrigerator descends and is accumulated at the lower part of the refrigerator. At this time, since the cooling of the storing box 22 (24) from its bottom surface is not performed, it is possible to prevent efficiently the lower part of the storing box 22 (24) from being over-cooled.

Figure 6:
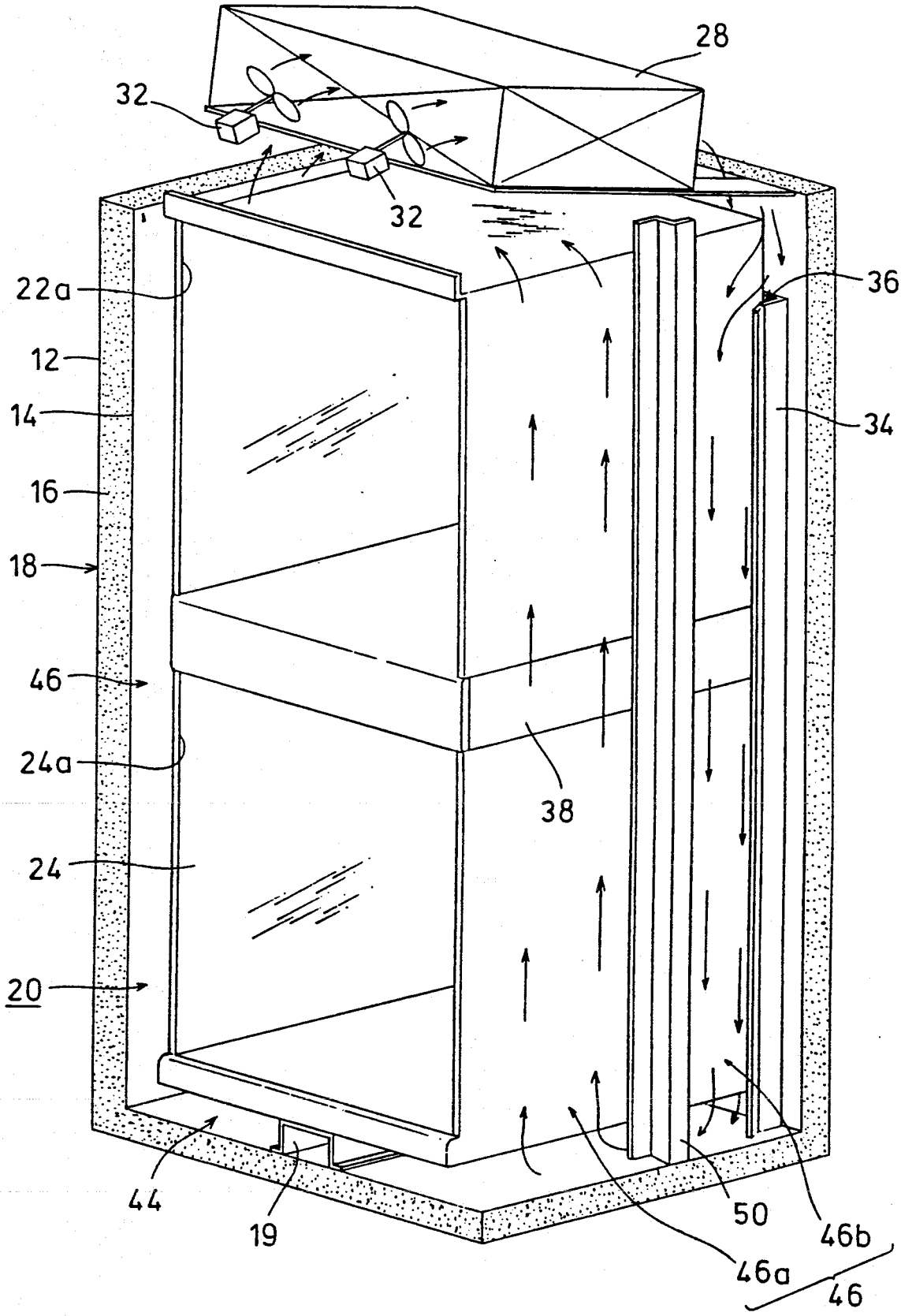
FIG. 6 is a schematic perspective view partly in longitudinal section for showing another preferred embodiment of a refrigerator of this invention.
Figure 7:
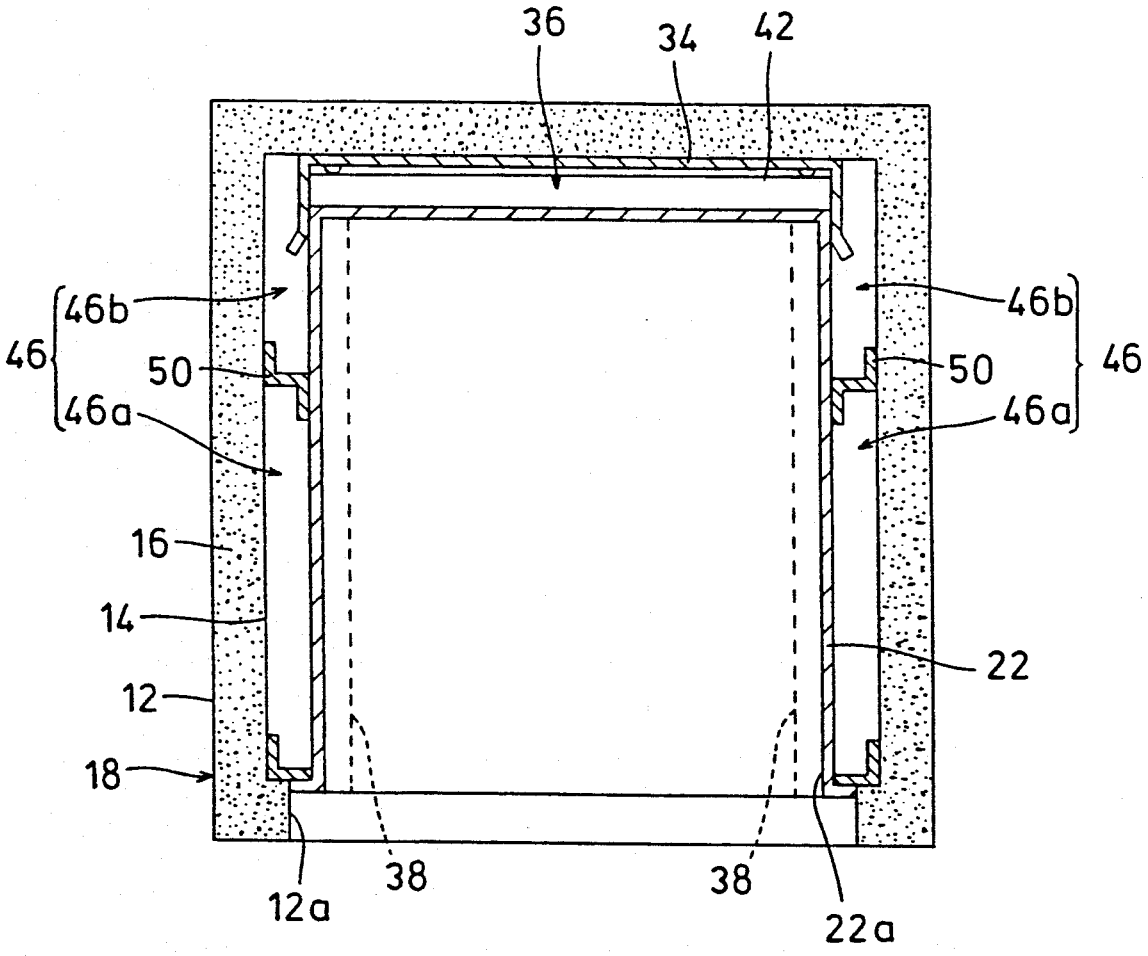
FIG. 7 is a top plan view in cross section for showing the refrigerator illustrated in FIG. 6.

Then, FIGS. 6 and 7 illustrate another preferred embodiment of this invention, in which the side passages 46 defined at the side surfaces of the storing boxes 22 and 24 are divided into the two passages 46*a* and 46*b*, and a part of the cold air flowing down the rear passage 36 is fed into one passage 46*a*.

As shown in FIG. 7, at each of the predetermined locations of the side passages 46 and 46 formed at the side surfaces of the storing boxes 22 and 24 is closely arranged each of the defining members 50 and 50 having a crank shape in section against an inner wall of the inner box 14 and the outer walls of the storing boxes 22 and 24 of the themal insulating box 18. The defining members 50 extend over an entire length in a direction of height of each of the side passages 46 so as to divide the passages 46 into two passages 46*a* and 46*b*. As shown in FIG. 6, a height of the storing box guide 34 arranged at an inner rear surface of the inner box 14 is set such that an upper end of the guide is lower than the ceiling surface of the upper storing box 22.

Accordingly, a part of the cold air blown from the cooling unit 28 to the rear passage 36 is flowed from the upper part of the storing box guide 34 into one passage 46*b* in the side passages 46 and then flows down the passage 46*b*. The two passages 46*a* and 46*b* divided through the defining members 50 communicate with each other through a bottom space 44 defined at the bottom surface of the lower storing box 24, so that the cold air may repeat a circulation in which the cold air flowed down the passage 46*b* flows into the passage 46*a*, ascends in the passage 46*a* and returns back to the cooling unit 28. That is, a part of the cold air blown from the cooling unit 28 and descending is contacted with the side surfaces of the storing boxes 22 and 24, thereby it is possible to improve the efficiency of the heat exchanging operation and to cool an interior of the refrigerator to a predetermined temperature within a short period of time.

Figure 8:
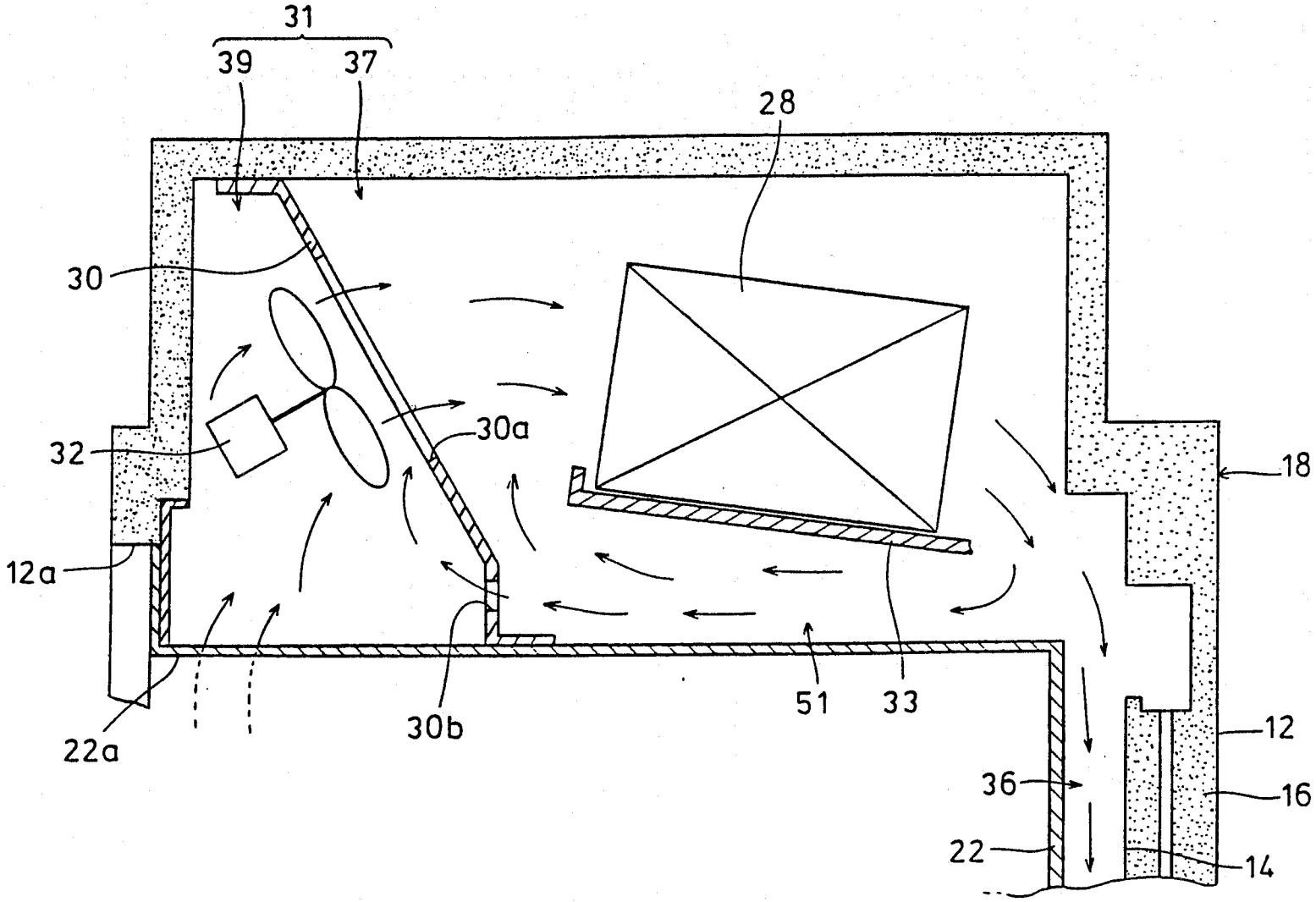
FIG. 8 is a substantial side elevational view in longitudinal section in an enlarged scale for showing an upper part of a refrigerator constructed in accordance with still further preferred embodiment of this invention.
Figure 9:
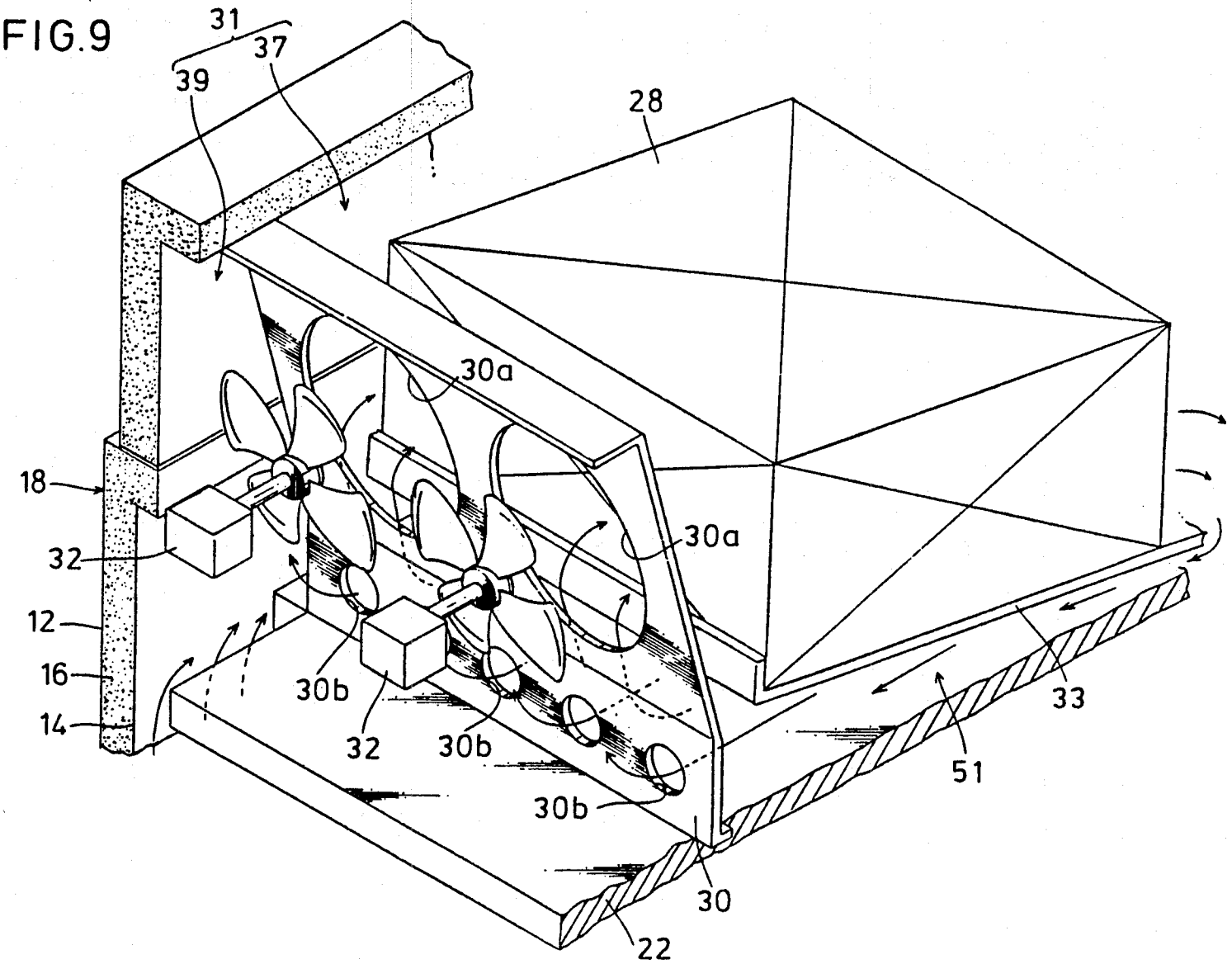
FIG. 9 is a schematic perspective view for showing an upper part of the refrigerator partly broken away illustrated in FIG. 8.

FIGS. 8 and 9 illustrate a still further preferred embodiment of this invention, wherein the cold air can be efficiently circulated in the cold air passage 51 defined between the ceiling surface of the upper storing box 22 and the water draining pan 33.

That is, as shown in FIG. 8, the dividing wall 30 for use in dividing a space 31 formed above the upper storing box 22 into a first chamber 37 and a second chamber 39 is provided with a plurality of through-holes 30*b* at locations opposing to the cold air passage 51. Due to this fact, a part of the cold air circulating in the cold air passage 51 is fed into the second chamber 39 showing a negative pressure under operation of the air blowing fan 32 via through-hole 30*b*. Accordingly, the entire ceiling surface of the upper storing box 22 forming the bottom surfaces of the chambers 37 and 39 divided by the partition wall 30 is cooled by the cold air blown from the cooling unit 28 and then a cooling efficiency of the storing box 22 is improved.

ACTION OF THE PREFERRED EMBODIMENTS

In accordance with the refrigerator constructed by the preferred embodiment of this invention, operation of the refrigerator causes the interior air at the side passages 46 and 46 to be sucked up by the air blowing fan 32, fed into the cooling unit 28 via the opening 30*a* of the partition wall 30, cooled through its heat exchanging operation, then the air is blown into the rear passage 36. A part of the cold air blown from the cooling unit 28 may perform a so-called short cycle in which it is circulated in the cold air passage 51 defined between the water draining pan 33 and the ceiling surface of the upper storing box 22 so as to cool the ceiling surface of the storing box 22.

As shown in FIG. 2, the cold air blown to the rear passage 36 contacts with the rear surface of the upper storing box 22 and flows down while performing a heat exchanging operation, abuts against the partition plate 42 and its flow direction is deflected. The cold air flows along the partition plate 42 and passes through the upper passage 40*a* of the horizontal passage 40, thereafter it passes through the lower passage 40*b* and flows into the rear passage 36 below the partition plate 42. At this time, the cold air may contact the bottom surface of the upper storing box 22 and the ceiling surface of the lower storing box 24 to perform a heat exchanging operation so as to cool the storing boxes 22 and 24.

The cold air which flowns again into the rear passage 36 contacts the rear surface of the lower storing box 24, flows down while performing a heat exchanging operation, thereafter the air is blown into the bottom space 44 and then contacts the bottom part of the storing box 24. In addition, the cold air may repeat such a cycle as one in which the air contacts both side surfaces of the storing boxes 22 and 24 while ascending in the side passages 46 and 46 so as to cool the storing boxes 22 and 24, thereafter the air is returned back to the cooling unit 28. Since the cold air blown into the bottom space 44 is heat exchanged between the upper and lower storing boxes 22 and 24 and heated, the cold air does not accumulate at the bottom part of the thermal insulating box 18 and the cold air may be efficiently circulated.

In this way, this invention is constructed such that each of the storing boxes 22 and 24 is cooled in both cases in which the cold air cooled by the cooling unit 28 is caused to descend and ascend, the interior of each of the storing boxes 22 and 24 can be cooled rapidly down to a predetermined temperature. Further, since the cold air is not accumulated at the lower part of the thermal insulating box 18, it is possible to make a uniform cooling of each of the storing boxes 22 and 24. In addition, since the cold air is circulated between the bottom surface of the upper storing box 22 and the ceiling surface of the lower storing box 24, it may provide an advantage that a cooling efficiency can be improved. In addition, circulation of the cold air from the rear surfaces of the storing boxes 22 and 24 to their side surfaces may effectively prevent water from forming under influence of surrounding atmosphere from being generated near the openings 22*a* and 24*a* of the storing boxes 22 and 14.

In the preferred embodiment shown in FIG. 1, it is made such that the cold air cooled by the cooling unit 28 is circulated through the rear passage 36, bottom space 44, side passages 46 and 46 and the cooling unit 28 so as to cool the storing boxes 22 and 24. However, both storing boxes 22 and 24 may rapidly be cooled similarly by circulating the cold air cooled by the cooling unit 28 through side passages 46 and 46, bottom space 44, rear passage 36 and the cooling unit 28.

As shown in FIG. 8, when the partition wall 30 is provided with through-holes 30*b*, a part of the cold air circulating in the cold air passage 51 may repeat a circulation in which the air is blown into the second chamber 39 via through-holes 30*b* and this cold air returns back again to the cooling unit 28 via opening 30*a*. That is, the through-holes 30*b* are formed at the locations in the partition wall 30 corresponding to the cold air passage 51, thereby the cold air passage 51 communicating with the second chamber 39 shows a negative pressure and the cold air blown from the cooling unit 28 may easily be flown into the cold air passage 51 (a short cycle is hard to occur). Thus, the cold air is contacted with an entire ceiling surface of the upper storing box 22, thereby a cooling efficiency can be improved and an interior of the refrigerator can be cooled to a predetermined temperature within a short period of time.

What is claimed is:

1. A refrigerator comprising a thermal insulating box provided with openings and thermal insulating doors arranged in the openings; storing boxes arranged within said thermal insulating box through a predetermined space and having openings released in correspondence with said openings; and a cooling unit arranged above one of the storing boxes in said thermal insulating box characterized in that:

an interior space of said thermal insulating box is divided into a first passage communicating with a cold air blowing side of the cooling unit so as to guide the cold air blown from said cooling unit to cool said storing boxes with falling cold air, and a second passage communicating with the cold air sucking side of the cooling unit to cool the storing boxes with raising cold air which has descended down to the bottom part of said thermal insulating box and to guide it to return to the cooling unit; and said first passage and second passage communicate with each other below said storing box, the first passage being defined at a rear side of the storing box and the second passage being defined at side surfaces of the storing box.

2. A refrigerator comprising a thermal insulating box provided with openings and thermal insulating doors arranged in the openings; storing boxes arranged within said thermal insulating boxes through a predetermined space and having openings released in correspondence with said openings; and a cooling unit arranged above one of the storing boxes in said thermal insulating box characterized in that:

an interior space of said thermal insulating box is divided into a first passage communicating with a cold air blowing side of the cooling unit so as to guide the cold air blown from said cooling unit to cool said storing boxes with falling cold air, and a second passage communicating with the cold air sucking side of the cooling unit to cool the storing boxes with rising cold air which has descended down to the bottom part of said thermal insulating box and again to guide it to return to the cooling unit; and said first passage and second passage communicate to each other below said storing boxes, the first passage being defined at the side surfaces of the storing box and the second passage being defined at the rear surface of the storing box.

3. A refrigerator comprising a thermal insulating box provided with openings and thermal insulating doors arranged in the openings; storing boxes arranged within said thermal insulating box through a predetermined space and having openings released in correspondence with said openings; and a cooling unit arranged above one of the storing boxes in said thermal insulating box characterized in that:

an interior space of said thermal insulating box is divided into a first passage communicating with a cold air blowing side of the cooling unit so as to guide the cold air blown from said cooling unit to cool said storing boxes with falling cold air, and a second passage communicating with the cold air sucking side of the cooling unit to cool the storing boxes with raising cold air which has descended to the bottom of said thermal insulating box and again to guide it to return to the cooling unit; and the bottom portions of said storing boxes are provided with some thermal insulating members.

4. A refrigerator comprising a thermal insulating box provided with openings and thermal insulating doors arranged in the openings; storing boxes arranged within said thermal insulating box through a predetermined space and having openings released in correspondence with said openings; and a cooling unit arranged above one of the storing box in said thermal insulating box characterized in that the same is further comprised of a partion wall for dividing a space defined above said storing box into a first chamber having said cooling unit arranged therein and a second chamber having said air blowing fan arranged therein and having an opening communicating with both chambers;

a cold air passage defined between the bottom surface of the cooling unit arranged in said first chamber and a ceiling surface of said storing box;

through-holes formed at locations in said partition wall in correspondence with the cold air passage in the first chamber; and a part of the cold air cooled by said cooling unit is circulated in the cold air passage within the first chamber to cool the ceiling surface of the storing box and at the same time the part of the cold air circulating in the cold air passage is fed into the second chamber via through-holes of the partition wall.

* * * * *